United States Patent [19]

Honaker et al.

[11] Patent Number: 4,935,288

[45] Date of Patent: Jun. 19, 1990

[54] COATED LASER PRINTED LABELS

[75] Inventors: Lewis R. Honaker, St. Charles County; Richard K. Bartley, Jefferson County, both of Mo.

[73] Assignee: American Label Systems, Inc., St. Peter, Mo.

[21] Appl. No.: 129,646

[22] Filed: Dec. 7, 1987

[51] Int. Cl.[5] ..... B41M 3/12

[52] U.S. Cl. ..... 428/207; 428/331; 428/332; 428/520; 430/945; 427/261; 427/265; 427/375; 283/81

[58] Field of Search ..... 428/331, 520, 207, 332; 430/945

[56] References Cited

U.S. PATENT DOCUMENTS 4,313,994 2/1982 Kingston ..... 428/347

4,767,696 8/1988 Ishimoto et al. ..... 430/945

*Primary Examiner*—P. C. Ives

*Attorney, Agent, or Firm*—Paul M. Denk

[57] ABSTRACT

A composition applied as a coating to material intended to be utilized as a label for displaying pricing, and other information, as in the supermarket, the composition including a solution of approximately 70% acrylic, or an overprint varnish, a silica flatting agent included at about 3% by weight, an alcohol solvent included at approximately 17% to 18% by weight, and an ester solvent at approximately 9% to 10% by weight. In alternative coating, such as for use in conjunction with differing printers, a water base solution must be employed, and this includes a solution of a 50% water based acrylic, having added to it approximately 25% by weight of water, and 25% by weight of extending varnish. The composition is applied to the label material by gravure roll, or any other flexographic printing process, dried, and then shipped to the supermarket or its headquarters wherein the label material can be cut, and printed upon one of the laser printers with the aforementioned data, for ready application.

9 Claims, No Drawings

COATED LASER PRINTED LABELS

BACKGROUND OF THE INVENTION

This invention relates generally to labels, for use on supermarket and related shelves, and which contains bar codes and identification of product, in its price, and more specifically, the invention pertains to a coating of the label which will prevent the scratching, smudging, and fading of the information upon the label during its usage.

In a supermarket, customers and employees often come into contact with such identification labels. People rub up against them, they are washed when the shelves are scrubbed, and they are nearly daily passed over with a scanning instrument for inventory or price adjustment purposes. As a result, using the present mode of printing bar codes on uncoated labels, the bar code is often smudged, scratched, and faded, making the reading of the bar code by the scanning instrument rather difficult and inaccurate.

Examples of coatings for paper, and other means, and the use of laser radiation to induce polymerization, is shown in a variety of prior art patents. For example, the patent to Parts, No. 3,477,932, shows and describes a laser radiation-induced polymerization. The invention describes the application of argon laser for radiating against chemicals in the category of acrylamides, and alkali acrylates, for the method of achieving polymerization of the unsaturated monomer. This particular invention is generally used in the photographic process industry. And, more specifically, it relates to the use of the photographic method for preparation of printing plates, and the like.

The patent to Lorenz, No. 3,761,942, is upon a low energy thermochromic image recording device. It utilizes a low energy radiation source that can be used to inscribe images upon a surface. It uses a plastic matrix that is apparently combined with the photochromatic material and can comprise any type of polymethacrylate, or other acrylic.

The patent to Eames, No. 3,962,513, defines a laser transfer medium for imaging printing plates. It includes a printing plate, of the type that incorporates an ink receptive layer, a laser responsive layer, and a substrate, or sheet of film or other material, and which is transparent to the laser energy. Once again, this patent is more concerned with producing an image upon a printing plate, rather than forming a coated vinyl, polymer, or paper material which can affect a more hardening of the laser printed ink, representative of the bar code or pricing information that is applied to a label.

The patent to Ronn, et al., No. 4,328,303, describes the preparation of metal containing polymeric material via laser chemistry. It pertains to the production of polymeric materials which include fine metal or metal oxide particulars dispersed therein, and then irradiating the shaped material with laser light to decompose the metal compound and apparently cause irradiation of the metal components within the polymer or formed plastic.

The patent to Yamada, et al., No. 4,383,029, pertains to a recording medium and recording system. This invention utilizes the laser for preparing recording tape, as for use in the video or related industries, through the use of the laser.

The patent to Takahashi, et al., No. 4,405,706, pertains to an optical information recording means. It incorporates a plastic substrate, made of an acrylic resin, having an undercoating comprising of at least of a polyvinyl pyrrolidone, but which further incorporates a heat mode recording layer of metal, on the said undercoating.

The patent to Mayer, No. 4,584,259, discloses a coated media for optical recording with acrylic overcoat. It pertains to an optical data storage system, one employing a data-modulated riding laser beam, and a non-erasing reading laser beam of predetermined wave length. The particular coating is rather extensive, and defines the usage of various in the forming of select layers onto the storage medium, wherein the storage medium includes at least one thermal recording area where information is thermally recorded thereon with prescribed laser radiation.

The patent to Abe, et al., No. 4,600,625, discloses another form of optical information recording medium. It is one that is capable of writing and reading with laser beam technology. It is more concerned with data storage, as for use in the computer industry, rather than for providing a protective coating or layer for more flexible materials, such as labels, or the like, of this current invention.

The patent to Umehara, No. 4,614,705, pertains to an optical information recording medium. It is used for providing a recording information track, of particular shaped pattern, formed of light, curable composition, and apparently sensitive to the active ray irradiation, such as from a laser, and comprising a coating of an acrylic and/or methacrylate formed of an alkyline glycol, and related compositions.

The patent to Dickie, No. 3,984,500, discloses a radiation polymerizable protective coating composition, such as a paint. While this composition includes various methacrylates within their coating composition, it primarily includes phosphates within the same.

Another patent to Dickie, No. 3,987,127, is another radiation protective coating, including a vinyl polymer, and phosphoric acid within its formula. Apparently these compositions are used as a coating upon vacuum metalized articles, such as upon an automobile, or the like. Another patent to Dickie, No. 3,991,230, relates to the same subject matter. A further patent to Dickie, No. 3,992,477, includes the addition of the foregoing ingredients within a paint to enhance its hardening when subjected to radiation. A further patent to Dickie, No. 4,000,349, pertains to the foregoing composition, mainly for use as a coating upon an article to resist abrasion and of corrosion.

The patent to Amberg, No. 4,008,347, shows a receptacle of foamed plastic lined with unoriented polyolefin film. While it includes a polyvinyl acetate within its composition, it is just totally distinct from the label coating composition of this current invention.

The patent to Mercurio, No. 4,023,977, discloses an acrylic means as a melt flow enhancer within thermal plastic coatings and powders.

A further patent to Dickie, No. 4,039,722, discloses a plural coating article and process for making same. But, once again, it is primarily related to vapor deposited metals, and coatings thereon, rather than as a protective coating for paper articles, labels, or the like.

The patent to Konno, No. 4,067,791, relates to an ultraviolet light curable coating composition, including benzophenone, and a lower arkyl ester of such acid. The composition is ultraviolet curable.

The patent to Wismer, No. 4,070,497, discloses a top coat for application over a coating which has been gelled by actinic light, and which is curable by ionizing irradiation.

The patent to Watt, No. 4,105,806, discloses a photo-initiator free ink and method. The patent describes the types of inks, and the method or producing printed and varnished surfaces by deposition of base film or printing on a substrate and depositing a protective varnish upon the previously applied multi-layers. The composition is then exposed to an energy source, such as electromagnetic radiation, to cure the varnish and ink.

The patent to -Andrews, No. 4,117,182, discloses a heat release layer for decalcomanias. This method is to provide some type of heat release layer, to the surface of decals, probably to enhance their adhesiveness.

The patent to Martorano, No. 4,126,595, discloses a water based therosettable coating composition adapted for direct roll coating of substrates. While it includes an acrylic copolymer, the particular formulation is very detailed in composition, and contains many other ingredients than that of this current invention.

The Matsubara patent No. 4,144,283, discloses a curable coating composition for paints and printing inks. It does contain an acrylic, but also a phenolic compound, but with ethylene or propylene, and not an acetate.

The patent to Barta, No. 4,211,809, defines a self-adhering, transferable layer of varnish (lacquer) or color.

Another patent to Barta, No. 4,211,810, defines a similar type of invention as previously explained in the last patent.

The patent to Watanabe, No. 4,275,106, defines a transfer sheet for polyamide articles. This is for use upon a transfer sheet, as for use for transferring designs onto articles.

The patent to Martorano, et al., No. 4,190,693, defines a water-based thermosettable coating adapted for direct roll coating of substrates. It includes ammonia salts, carboxylic acid, and an aqueous solution, which are mixed together into the composition.

The patent to Vrancken, et al., No. 4,206,025, , defines a radio-hardenable acrylic polyester.

The patent to Pujol, et al., No. 4,238,533, defines a coating process and apparatus. It is for coating polyester film, by a particular feeding method.

The patent to Andrews, No. 4,303,717, defines another form of heat release layer for decals.

The patent to Ray, No. 4,324,823, explains a means for effecting tamper resistance for on-package peelable premiums.

The patent to Takashina, No. 4,329,269, defines a package system cold-setting type of coating composition, including an acrylic co-polymer, but then defines an aluminum alkoxide, and other ingredients.

The patent to Girard, No. 4,331,713, defines a process for continuously coating a sheet article, and which also includes the application of pressure, in order to assure spreading of the coating composition, and then conducting the sheet article between a roll and spreading blade.

The patent to Altschuler, No. 4,369,283, defines a high solids can coating composition containing epoxy, acrylic, and aminoplast resins. It pertains to a can coating composition.

The patent to Sugiura, No 4,388,445, defines a heat-curable coating composition. It does include a polyester, of a particular configuration, combined with an alkyd resin, and a hydroxl-containing acrylic resin.

The patent to Kawamura, No. 4,439,557, does define a coating incorporating an acrylic polymer, but it also includes fine particulate silica, and a curing catalyst, which is just not contained in the current invention.

The patent to Kania, No. 4,603,064, explains a color plus clear coating method utilizing interpolymers from acrylate, but which contains alkoxysilane. These coatings are used primarily in the automotive industry, in order to provide a clear top coating for, probably, the automobile body.

The patent to Liu, No. 4,604,297, explains a transmission enhancing coating.

The patent to Ohmura, No. 4,604,425, describes the method of modifying the surface of a polymer material, by adding a block co-polymer, which is formed of a hydrophilic polymer, but which is polymerized in the pressence of polymeric peroixde.

Finally, the patent to Wolfersperger, No. 4,636,273, explains the process for manufacturing covers for containers opened by peeling off of said covers.

The foregoing are the patents known to the applicants pertaining to this particular concept, or having some relationship thereto, and uncovered in various prior art searches, conducted upon the applicants'current invention.

SUMMARY OF THE INVENTION

It is the principal object of this current invention to provide a compound which will minimize the smudging, scratching, and fading of information upon labels, particularly those use in the retail marketplace.

It is a further object of this current invention to provide a method for applying the compound to the labels.

This invention contemplates a compound which is applied to supermarket shelf labels, more specifically, before the printing of specific information is made upon the labels. The coating is made from a mixture of ingredients that enhance the staying characteristics of any information that may be printed upon the label, such as by one of the laser printing apparatuses, currently used in the trade. Through usage of this current invention, the laser printed bar codes, prices, weights, sizes, and oher information is fused permanently into the labels prepared by this current invention, because such lables are uniquely pretreated to permanently bond all laser printed data onto the label during their preparation and usage. There is no post processing labor or material costs that are involved once the labels are prepared, and applied to the market shelf, since smudging and scratching just does not occur. The labels are available and readily applicable for permanent usage for whatever length of time they are required, until such time as different prices, weights, sizes, or the like, is necessary, and therefore requires the preparation of a new label for identification purposes to the retail trade. The labels of this current invention can withstand significant abuse, just as much if not more as the ultraviolet coated labels, or the laminated labels, that have also seen some usage.

The bonding of printed information, particularly from the laser printers, such as the Xerox or Siemans printer that laser transfer images onto supporting materials, such as labels, and which laser printers are readily available and in usage from companies such as Siemans, comprises the essence of the usage of this current invention. Through the usage of the laser printer, and the labels prepared by this current invention, the retailers can produce shelf labels equal to, or of superior quality to, the externally printed type of shelf labels that have long been used in the trade. The current invention enhances label usage, and sustains their useful life, regardless whether printed images, whether in black in white, colored, or the like, are applied to the previously prepared label materials in preparation for their reception of the laser printed data. The current invention works equally well in the preparation of quality labels in the variety of formats upon paper, vinyl, or other sythetic stock.

The mixture of this current invention includes (a) a silica flatting agent, that adds a texture to the surface of the paper or vinyl label being printed, to facilitate its passage through the laser printers, (b) an alcohol solvent, (c) an ester solvent, and (d) a solvent based flexographic acrylic varnish, such as one incorporating an acrylic resin. Acceptable ranges for the four components are within the range of from 50% to 84% for the varnish, 1% to 5% for the silica flatting agent, 10% to 25% for the alcohol solvent, and five percent to 20% for the ester solvent. All percentages are by weight. The alcohol solvent used is a saturated alcohol of from one to four carbon atoms. Alcohols that may be used are ethanol, methanol, iso-propanol, n-propanol, n-butanol, set-butanol, iso-butonal, and t-butonal. The ester used in this composition has the structure of:

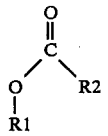

wherein R1 may be any saturated hydrocarbon of from one to four carbons, and R2 may be any saturated hydrocarbon with one to carbons. Ester solvents which may therefore be used include ethyl acetate, methyl acetate, n-propyl acetate, and iso-propyl acetate. The flexigraphic varnish used as a fast drying solvent based varnish.

This compound forms a coating that is applied over the blank label material prior to shipment to the supermarket. At the market or at its administrative office, the price information, product name, bar code, and other information is laser printed on the coated label The ink reacts with the coating, and through its laser application becomes hardened, and impervious to smudges, scratches, and fading.

If a Siemans Corporation style of laser printer is used, a different solvent must be included within the composition, other than the previously identified solvents. Because the Siemans printer uses a different ink, this reaction, between the ink and the coating, does not occur. To overcome this problem, the process in modified in that the precoating upon the label material utilizes a water based solvent, rather than that identified. It includes a 50% solution of water based acrylic, such as an acrylic resin that is ammonia soluble, and adds to that the remaining 50% solution of one-half (½) water, and one-half (½) extending varnish, which may include an acrylic resin, from Sun Cheical. This type of modification to the precoating is applied to the label material when it is going to be used with the Siemans Corporation type of laser printer.

DESCRIPTION OF THE PREFERRED EMBODIMENT

In the production of the compounds for use in conjunction with this invention, the preferred amounts of the four ingredients are as follows:

Overprint varnish approximately 70.0% by weight
Silican Flatting Agent approximately 3.0%
Alcohol Solvent approximately 17.2%
Ester Solvent approximately 9.8%

The solution which makes up the coating is approximately 70% solvent based acrylic, which comprises approximately 70% of the completed solution. The remaining 30%of the solution is a mixture of approximately 75% ethyl alcohol, while the remaining approximately 25% is normal propyl acetate. The acrylic is made by dispersing the silica flatting agent in the varnish or acrylic. Any silica flatting agent may be used, such as that sold under No. OK412 from DeGussa. The varnish used is a fast drying flexographic varnish, such as that sold under No. SL86 8603, available from the G.P.I. Division of the Sun Chemical Corporation, in Carlstadt, New Jersey The flatting agent is dispersed such that the flatting agent particle size is greater than twenty-five microns as measured by the Hegman gauge. A cowless type dispenser is used to attain this required dimension. The remaining 30% of this solution, made from 75% alcohol and 25% ester, is then added to the acrylic. The alcohol used is a saturated alcohol with from one to four carbon atoms. Denatured ethyl alcohol is preferred. On the other hand, as previously stated, any one of methanol, isopropynol, n-propynol, n-butanol, se-butanol, iso-butanol, and t-butanol, may be employed. These homologues of the ethyl alcohol have been found to be effective in the composition.

The ester has a structure of R2-COO-R1, wherein both R1and R2 are saturated hydrocarbons, or one having from one to four carbon atoms, and R2 having one or two carbons. Ethyl acetate is preferred. On the other hand, other homologues of ethyl acetate may include methyl acetate, n-propyl acetate, and iso-propyl acetate.

Because not all ink will react properly with this coating, an alternative solution must be used for certain printers. If the Siemans printer is to be used to print the labels, then as previously described, the solution must be a 50% water based acrylic, including 25% water, and 25% extending varnish.

If the label is to have any background coloring, such coloring is printed on the label prior to coating. After this initial printing, the compound is applied to the blank label, to a thickness of approximately one-half milimeter. The labels are preferably polymer or vinyl, but paper labels may also be used. The coated labels are then shipped to the supermarket, where the necessary information, as previously explained, is printed thereon.

The coating may be printed using a flexographic printing process. To accommodate mass coating of labels, the coating may be applied to 8 ½×11 inch sheets which are then cut into labels. Alternatively, the coating may be applied to a roll, which has a width equal to the width of the label, with said roll then being cut into labels after printing.

Variations or modifications to the subject matter of this invention may occur to those skilled in the art upon reviewing the disclosure herein. Such variations, if witin the spirit of this invention, are intended to be encompassed within the scope of any claims to patent protection issuing upon this invention. The description of the preferred embodiment set forth herein is done so for illustrative purposes only.

Having thus described the invention what is claimed and desired to be secured by Letters Patent is:

1. A data displaying label having a substantially continuous film coating applied to at least one face thereof, said film coating comprising a laser printable acrylic based pre-mixed compound of select proportions, said compound forming the coating including approximately 50%–84% by weight of the printable acrylic, approximately 10% –25% by weight of an alcohol solvent, approximately 5–20% by weight of an ester solvent, and approximately 1%–5% by weight of a silica based flatting agent, and said film coating adhering the laser pigment ink to the coated label with an immediate bonding and fusing of the ink to the coated label during preparation of the label with the desired data, in order to provide a printed label that will not smudge, scratch or fade.

2. The label as defined in claim 1 wherein said coating is applied to a label substrate constructed from a polymer, vinyl or paper label stock.

3. The label is defined in claim 2 wherein said coating is applied as a continuous film coating of approximately one-half millimeter in thickness by a flexographic printing process.

4. The label as defined in claim 3 wherein a background color is pre-printed on the label prior to the application of said continuous film coating.

5. The label as defined in claim 1 wherein said acrylic based pre-mixed compound is a solvent based acrylic.

6. The label as defined in claim 1 wherein said acrylic based pre-mixed compound is a water based acrylic.

7. The label as defined in claim 5 wherein said coating including said solvent based acrylic is approximately 70% by weight, said solvent alcohol is approximately 17.2% by weight, said ester solvent is approximately 9.8% by weight, and said silica flatting agent is approximately 3% by weight.

8. The label as defined in claim 5 wherein said alcohol solvent is a saturated alcohol with one to four carbon atoms, and wherein the ester solvent has a structure of:

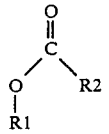

and wherein $R_1$ is a saturated hydrocarbon residue with from one to four carbons, and $R_2$ is a saturated hydrocarbon with from one to two carbons.

9. The label as defined in claim 6 wherein said water-based acrylic is a 50% water based acrylic containing 25% water and 25% extending varnish.

* * * * *